US006709300B1

(12) United States Patent
Brooks

(10) Patent No.: US 6,709,300 B1
(45) Date of Patent: Mar. 23, 2004

(54) FEMALE CONNECTORS FOR USE WITH MALE ELECTRODES

(76) Inventor: Dennis L. Brooks, 1313 Laredo St., Aurora, CO (US) 80011

( * ) Notice: Subject to any disclaimer, the term of this patent is extended or adjusted under 35 U.S.C. 154(b) by 0 days.

(21) Appl. No.: 10/288,670

(22) Filed: Nov. 7, 2002

(51) Int. Cl.[7] ..... H01R 11/22; H01R 13/11; H01R 4/48

(52) U.S. Cl. ..... 439/852; 439/842; 439/821

(58) Field of Search ..... 439/852, 842, 439/621, 622, 214, 76.2, 821

(56) References Cited

U.S. PATENT DOCUMENTS 4,142,810 A * 3/1979 Lesaint ..... 403/252
4,842,534 A 6/1989 Mobley et al.
4,944,697 A 7/1990 Dorman
5,176,544 A * 1/1993 AbuJudom et al. ..... 439/878
5,285,011 A 2/1994 Shimochi
5,478,244 A 12/1995 Maue et al.
5,480,320 A * 1/1996 Saimoto ..... 439/852
5,616,041 A * 4/1997 Brown et al. ..... 439/222
5,667,414 A * 9/1997 Karacora ..... 439/849

OTHER PUBLICATIONS 2 page printout from the Zierick Manufacturing Corporation (Radio Circle, Mount Kisco, NY 10649) website, showing p. 50 in catalogue No. 40, copyright 2002.

True copy of p. 43 of a 1992 catalogue from the Zierick Manufacturing Corporation (Radio Circle, Mount Kisco, NY 10649).

* cited by examiner

*Primary Examiner*—Chandrika Prasad
(74) *Attorney, Agent, or Firm*—Michael B. Henson; Timothy J. Martin; Rebecca A. Gegick

(57) ABSTRACT

The female connectors are made up of a power part (9), (15) (23), (34), (37), and a male electrode receiver (10), (16), (24), (38), (41) (46). The male electrode receiver is made up of a short right-angled part (11) (18) (26) (48); a first flat section (12) (17) (25), an arced section (13) (19) (27) (47) and a second flat section (14) (21) (29). The arced section can have the flat portion (20) and the second flat section can have a right-angled extension (30). The power part can be a bus bar (49) or a male electrode as indicated by a dashed line (51).

14 Claims, 2 Drawing Sheets

FEMALE CONNECTORS FOR USE WITH MALE ELECTRODES

BACKGROUND OF THE INVENTION

This invention relates to female connectors used with electrical circuitry and more particularly in fusing and similar circuitry where the conductivity when utilizing male "spade" electrodes, is a significant factor.

The automotive industry has responded to the public's demand for a variety of additional accessories by increasing battery and alternator outputs. However, the resulting volume of space required to hold the larger batteries, fuse blocks, and additional circuit wiring has created problems with respect to siting these components. The need to reduce component weight has also resulted in fuse block connectors and fuse size reductions which result in higher operating temperatures.

Circuit operating temperatures are often high enough that 15 amp fuses are substituted in 10 amp circuits to reduce fuse failure rates. Overheating and vibration causes metal fatigue to occur in the connectors which ultimately leads to looser fits between the electrodes resulting in higher resistance at the connections. This phenomenon is particularly apparent as the connectors and/or fuse electrodes age.

The connectors of this invention have two elements. The first is a female element designed to receive a spade electrode. The second element can be connected to cables, wires, circuit board traces and all other inputs or outputs. In the description of the invention, the second element can be in any one of the forms used in circuitry required to adapt the first element to a particular application.

The connectors of this invention overcome some of the problems facing industry by providing rolled male electrode receivers which apply more uniformly distributed pressure on spade-type electrodes. The male electrode receiver designs increase the contact area, in the preferred designs, by providing more surface contact to the spade electrodes. This additional contact area increases both the electrical and thermal conduction, reducing the heat produced at the junction between the electrodes and increasing the transfer of generated heat away from the junction.

SUMMARY OF THE INVENTION

The connector units have a power part and a male electrode receiver. The power part connects to one or more circuits and/or power sources, e.g., bars and/or wires, and can be small where it is to be connected to a circuit board. The male electrode receiver is preferably rolled, but can be folded, to provide uniform spring pressure on the opposed surfaces which receive a spade electrode. The combination can include one or more mechanisms for attachment to a support where required, e.g., for connection to a circuit board, a bus bar or in a module. No support may be needed where the connectors are part of a wiring bundle or where a single wire is involved.

DETAILED DESCRIPTION OF THE FIGURES

Figure 1:
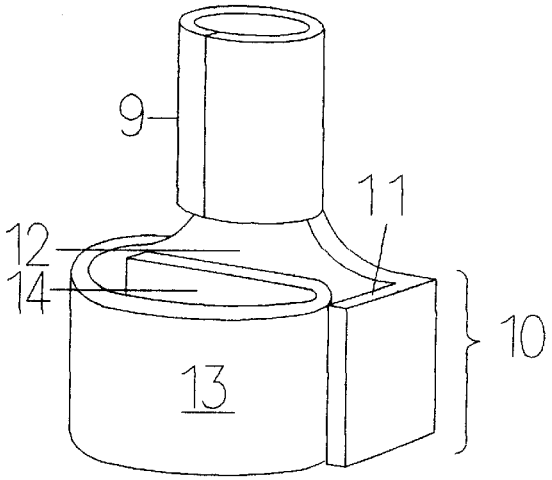
FIG. 1 is a perspective view of a preferred model of a female connector of this invention having a rolled section.

FIG. 1 depicts a female electrode having a tubular power part 9 which extends downwardly and outwardly to form a male electrode receiver 10 having, on one side, a short right angled part 11 and a first flat section 12 between the right-angled part 11 and the arced section 13 which, for the most part, is continuously bent in a series of changing radii to form an irregular arc which recurves to form a second flat section 14 opposite and parallel to the first flat section 12.

Figure 2:
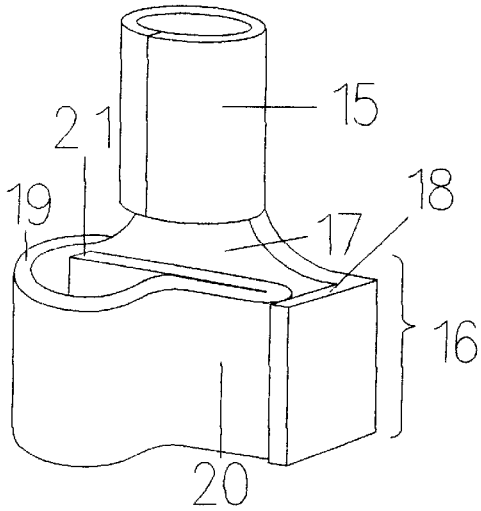
FIG. 2 is a perspective view of a second preferred model where the curves form a rolled section which is centrally integrated with a flat portion.

FIG. 2 depicts a preferred model of a female electrode with a tubular power part 15 which broadens out at its bottom (as viewed) to form a male electrode receiver 16 with a first flat section 17 which expands into a right angled pat 18 on one side and to a rolled regular arc section 19 which is bent into a flat portion 20. Flat portion 20 then bends to form a second flat section 21 parallel to and opposite the first flat section 17. These units are designed to provide a well equalized spring-loaded pressure on a male electrode (not shown) inserted into the male electrode receiver 16.

Figure 3:
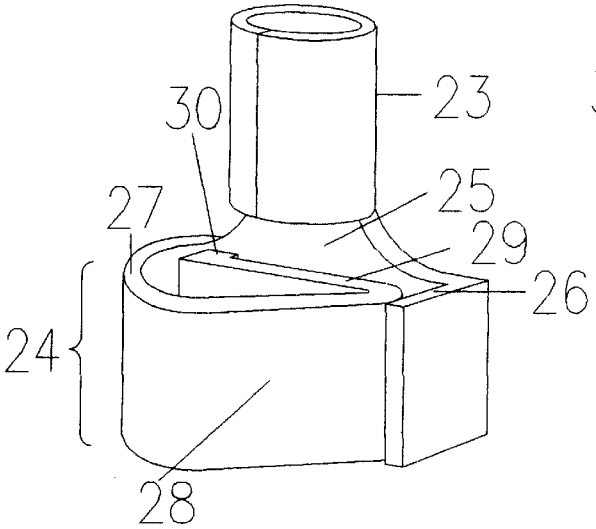
FIG. 3 provides a perspective view of a third model.

FIG. 3 depicts a female electrode with a tubular power part 23 for solder connection or crimping to a wire or cable. The base of connector 23 flattens and extends downwardly to form a male electrode receiver 24 with a first flat section 25 and bent to form a right angled part 26 on one side and, on the other side, a rolled arced section 27 having continuously changing radii, leading to a substantially flat area 28 in the irregular arc before recurving sharply to form a second flat section 29. Section 29 also bends at its end to form a right-angled part 30 for better insertion guidance. Right-angled part 30 must have less depth than the thickness of the connecting male electrode (not shown) to avoid interference within the connector.

Figure 4:
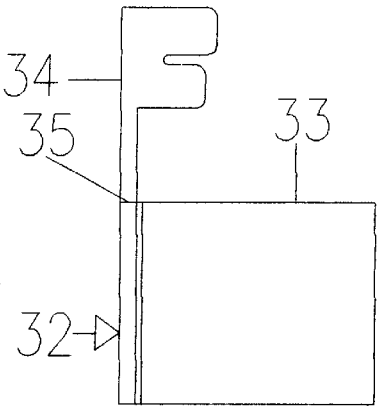
FIG. 4 depicts a side view of a model similar to that of FIG. 1 having a side mounted, crimpable power part for attaching a wire.
Figure 7:
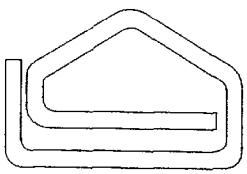
FIGS. 7 and 8 are end views of the folded connectors of FIGS. 5–6, respectively.

FIG. 4 depicts a female connector 32 which utilizes the folded cross section 33, shown in FIG. 7 and a commonly utilized, crimpable wire receiver 34, which is attached to the upper edge of the right angled part 11 (see FIG. 1). The right-angled part 11 is lengthened to accommodate a wire or cable receiver 34. The power part is fused to the male electrode receiver at point 35.

Figure 5:
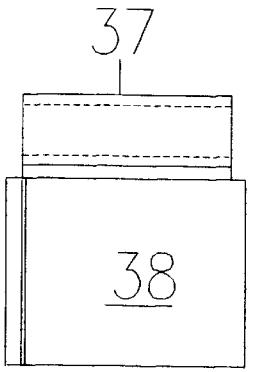
FIG. 5 depicts a front view of another model which is folded into the configuration of FIG. 1 except that the tubular wire power part is positioned perpendicular to the male contact insertion axis.

The connector 24 of FIG. 3 is modified in FIG. 5 to have the tubular wire receiving power part 37 located along the top of the first flat section (not shown) of the male electrode receiver 38 with the folded cross section shown in FIG. 7.

Figure 6:
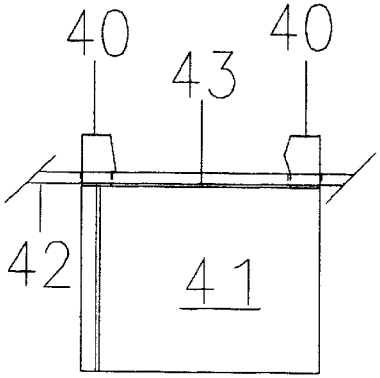
FIG. 6 depicts a front view of a model mounted on a circuit board with mechanically twistable attachment elements.

FIG. 6 depicts a model utilizing two twistable ear connectors 40 which attach the male electrode receiver 41 to a support, e.g., a circuit board or bus bar 42. A minimal height power part (not shown) is soldered to a trace 43 on the circuit board 42. This model has the folded male electrode receiver 41 configuration shown in FIG. 8.

Figure 8:
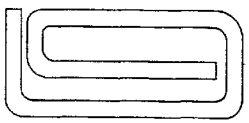

FIGS. 7 and 8 depict, respectively, a view of the lower ends of the male electrode receivers of FIGS. 5 and 6.

Figure 9:
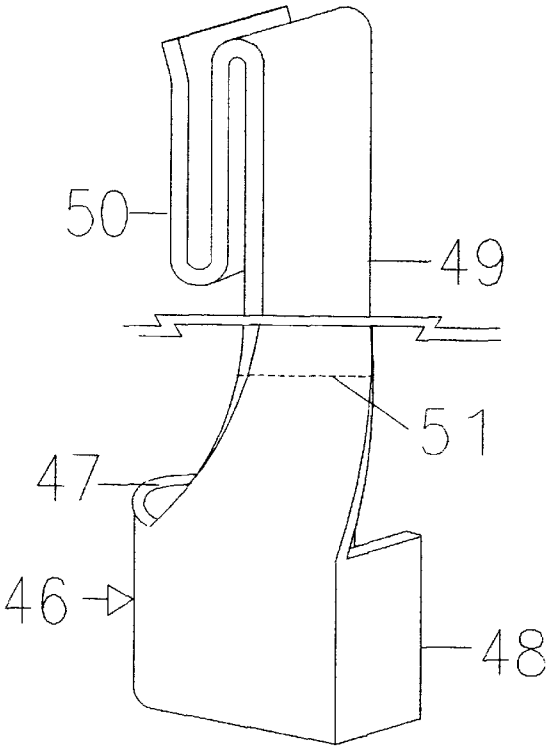
FIG. 9 depicts a rolled male electrode receiver connected to bus electrode by a bar having a quarter twist.

FIG. 9 shows a male electrode receiver 46 with a rolled arced section 47 and a right-angled part 48. It has a power part in the form of a bar 49 connected to a "Y" electrode 50 for carrying large electrical power loads. The connecting bar 49 can be of any length and the electrode 50 can be of any shape. The dashed line 51 shows that the bar can be short enough for the connector to act as a male/female connector.

GENERAL DESCRIPTION OF THE INVENTION

The parts of the connectors can be, as shown in the Figures, in one piece, or more and the connectors can be employed wherever terminals/connectors can be used. While the preferred forms are taught in FIGS. 1–3, other forms are useful, e.g., those of FIGS. 4–8. The female electrodes will generally be of an appropriate, annealed material, generally copper, brass or bronze. Where required, the electrodes can have a spring-type clamping mechanism for a non-soldered and non-crimped attachment to a wire or other conductor.

The male electrode receiver will generally be of the same material as the circuit connector portion, preferably acting as a spring to ensure a tight fit on both sides of a male electrode inserted into the male electrode receiver. The male electrode receivers are drawn with first and second flat surfaces but these surfaces can be curved or of another shape that will produce the required full double surface contact. Preferably, the insertion edges of the receivers will be chamfered or angled outwardly. The size of the male electrode receivers and the thickness of the metal depend upon the circuit parameters of the application where the male electrode receivers are used.

What I claim is:

1. In a female electrode, the improvement comprising a power part connectable to a source of electrical power and a male electrode receiver having an extension forming a first flat section extending to a right angled part on one side and, on the other side, the male electrode receiver including a folded arc section which recurves to form a second flat section substantially parallel to and opposite to the first flat section.

2. The female electrode of claim 1 in which the male electrode receiver has a section with a regular curve.

3. The female electrode of claim 1 which the male electrode receiver section has an arc section with an irregular curve.

4. The female electrode of claim 1 in which the male electrode receiver includes an arc section leading to a flat portion which then recurves to form a second flat section.

5. The female electrode of claim 1 in which the power part is tubular.

6. The female electrode of claim 1 in which the power part is crimpable for crimped attachment to a power source.

7. The female electrode of claim 1 in which the power part is tubular and positioned parallel to the top of the first flat section.

8. The female electrode of claim 1 in which the female electrical connector further includes twistable ear projections.

9. The female electrode of claim 1 in which the male electrode receiver metal has a predetermined spring characteristic.

10. The female electrode of claim 1 in which the power part is fusable with a trace on a circuit board.

11. The female electrode of claim 1 in which the male electrode receiver includes a second right angled part.

12. The female electrode of claim 1 in which the power part is a male electrode.

13. The female electrode of claim 1 in which the power part includes a connecting bar attached to another electrode.

14. The female electrode of claim 1 in which the power part extends into a female electrode.

* * * * *